United States Patent [19]

Shimizu et al.

[11] Patent Number: 4,956,242

[45] Date of Patent: Sep. 11, 1990

[54] STEEL FOIL FOR DRAWING CONTAINER WITH ORGANIC FILM COAT

[75] Inventors: Keiichi Shimizu, Hikari; Junichi Tanabe, Yanai; Toshio Sugawara, Hikari; Tsuneo Inui, Tokuyama; Yoshikazu Kondo, Kudamatsu, all of Japan

[73] Assignee: Toyo Kohan Co., Ltd., Tokyo, Japan

[21] Appl. No.: 352,007

[22] Filed: May 15, 1989

[51] Int. Cl.[5] ..... C22C 38/04

[52] U.S. Cl. ..... 428/606; 148/320

[58] Field of Search ..... 428/606; 148/320

[56] References Cited

U.S. PATENT DOCUMENTS 4,810,589 3/1989 Kuwamoto et al. ..... 428/606

FOREIGN PATENT DOCUMENTS 61-284530 12/1986 Japan .

*Primary Examiner*—Deborah Yee

*Attorney, Agent, or Firm*—Felfe & Lynch

[57] ABSTRACT

A steel foil for drawing a container with an organic film coat which is characterized of superior drawability, which includes 0.06% and under carbon, 0.1 to 0.5% manganese, 0.01 to 0.10% aluminum and the balance of iron and inevitable impurities, and the foil having a crystal grain size which is 7.5 to 10 in grain size number (JIS G 0552) and the foil having a ratio of peak values of P(222) to P(200) in intensity of X-ray diffraction in a plane parallel to a sheet surface, i.e. a P(222)/P(200) ratio, which is larger than 0.6 and which has a yield strength of 20 to 45 kg/mm$^2$ and a thickness of 50 to 100 $\mu$m.

1 Claim, No Drawings

STEEL FOIL FOR DRAWING CONTAINER WITH ORGANIC FILM COAT

This invention relates to a steel foil to be formed into a container with a coat of organic film by a drawing operation, and particularly to a steel foil with superior drawing characteristics with less occurrence of wrinkles while drawing.

A metal foil for drawing into a container has been conventionally materialized by aluminum foil. For steel foil, manufacturing techniques are more difficult and costly than aluminum foil when thickness is smaller than 100 μm, and furthermore drawing techniques for steel foil had not been established prior to the present invention. Under such circumstances, in fact, almost no studies on steel foil in terms of prevention of wrinkles in drawing and improvement of drawability have previously ever been executed. Prior art pertaining to steel foil which has superior drawing characteristics and is reduced in wrinkling to be caused, that is an object of the present invention, could be Japanese Patent Laid-Open No. 61-284530. This prior invention Laid-Open No. 61-284530 is characterized in the prevention of age hardening due to use of Ti, a very special element, waiver of skin pass rolling subsequent to annealing attributable to the foregoing, and rapid heat treatment for one to ten seconds. This can provide a steel foil having better drawability than general work-hardened as cold-rolled steel foil, although it cannot compare to common continuous annealed materials. In this regard, a level of drawability for the present invention is believed to be far higher than that required for common continuous annealed materials, so that a steel foil provided by the prior art cannot satisfy the level of drawability of the present invention. Another point where the prior art is not appropriate to the present invention is that the prior art uses unknown Ti which is undesirable on the account of sanitary food processing because the present invention is primarily intended for a container for food products. Furthermore, rapid heat treatment is mandatory in the prior art wherein a grain size obtained should be so fine that it cannot be a certain grain size as suitable to prevent wrinkles at a blank-holding face according to the present invention. The prior art has been described so far with respect to processing of steel foil. Next, a steel sheet with thickness roughly 0.2 to 0.3 mm which is applied to drawn or redrawn cans in wide range is far greater in thickness than a range 50 to 100 μm appropriate to the present invention.

Containers made of steel sheet with 0.2 to 0.3 mm thickness are to be coated with an organic film in about 10 μm thickness, and formed by drawing after baking. Upon drawing, the container is put in use without any repair coating for the reason of cost. In these drawn-containers of steel sheet, since the steel sheet is very thick for the thickness of an organic film to be coated, there have been almost no wrinkles caused at the blank-holding face but the problem has been surface roughening from drawing, so-called 'orange peel'. If this orange peel is significant, it would be cause of cracking in the coating. Such a defect in the coating could immediately result in adverse effect on corrosion resistance because no repair coating is usually performed, and the sheet then would lose its serviceability as container. Thus, in order to reduce surface roughening, a smaller crystal grain size such as 11 to 12 in number, as compared with the grain size of the material, has been applied for drawn-containers of steel sheet.

When a steel foil is to be drawn into a container, an organic film is coated and drawn, for the reason of cost. However, when compared with the case of steel sheet drawing, steel foil drawing is executed with a thicker organic film to be coated, because it is not so easy for a steel foil container to attach an end by double seaming as it would be in a steel sheet container and so the end will be attached by heat sealing. To assure the sealing effect of heat sealing, the inventors select at least 20 μm thickness of heat sealable organic film. Thus, the thickness of organic film for steel foil draw container is very much greater than that for a steel sheet one, and as a result the former tends much more to cause wrinkling at the blank-holding face during drawing. If a wrinkle exists at the heat sealing face, it could cause incomplete sealing of the drawn shell against the end, and consequently cause serious problems such as leakage or putrefaction of contents. Therefore, it is especially necessary for steel foil for forming into a drawn container with an organic film coating to have less occurrence of wrinkling as well as to have superior drawability.

When a container is formed by drawing a 50 to 100 μm steel foil coated with an organic film thicker than 20 μm, it is required that the foil tends hardly to cause wrinkling while drawing and at the same time should have high drawability as above mentioned. The present invention is characterized in that, to solve the aforementioned problems, the composition, crystal grain size, texture and yield strength of a steel used are determined by proper selection as the inventors have done after repeated studies done in order to obtain a steel foil with less occurrence of wrinkles and superior drawability, which will then be described as follows.

In accordance with the invention, a steel foil for drawing a container with an organic film coat which is characterized of superior drawability comprises 0 06% and under carbon, 0.1 to 0.5% manganese, 0.01 to 0.10% aluminum and the balance of iron and inevitable impurities, and the foil having a crystal grain size which is 7.5 to 10 in grain size number (JIS G 0552) and the foil having a ratio of peak values of P(222) to P(200) in intensity of X-ray diffraction in a plane parallel to a sheet surface, i.e. a P(222)/P(200) ratio, which is larger than 0.6 and which has a yield strength of 20 to 45 $kg/mm^2$ and a thickness of 50 to 100 μm.

When carbon content is more than 0.06%, work hardening through drawing becomes significant and also drawability comes down. From this, its upper limit is 0.06%. While, manganese content needs be limited to 0.5% for the upper limit because the higher the manganese content is, the more hardening and thus tendency of occurrence of wrinkling is promoted, and 0.1% for the lower limit in order to prevent adverse effects of sulfur which exists inevitably. For aluminum, 0.01% is the lower limit that is necessary for deoxidation and 0.10% is the upper limit since higher content of this will make the cost increase and result in much more inclusions. A crystal grain size is 10 for the upper limit because grain size in excess of 10 in number (JIG G 0552) increases the tendency of wrinkling caused at the blank-holding face. While, the lower limit is 7.5 because coarser sizes, smaller than 7.5 in number, become superior in wrinkling property but decrease in drawability even with suitable texture, as hereinafter described, that is, it tends more easily to develop fracture in drawing. In this respect, a grain size range of 7.5 to 10 as appropriate to a steel foil drawing container according to the present invention is much coarser than a grain size range for a steel sheet drawing container. This might mean a good possibility of cracking of the coating from surface roughening as has been generally unsuitable, but the said range 7.5 to 10 is on the contrary free from cracking of the coating because the thickness of coating film is so thick as 20 μm or more and yet material of the film to be coated is not of a thermohardening type as commonly used for steel sheet drawing containers but is a thermoplastic resin such as polypropylene, polyethylene, etc. Moreover, for the texture, if a ratio of P(222)/P(200), a ratio of peak value P(222) to peak value P(200) in crystal plane intensity parallel to a sheet surface as measured by X-ray diffraction, is less than 0.6, then a drawing ratio is too large to draw properly and causes wrinkling easily. For such reason, the ratio of P(222)/P(200) is 0.6 and larger. However, as aforementioned, even if the ratio of P(222)/P(200) is larger than 0.6, when a grain is so coarse as lower than 7.5 in size number, then fracture tends more to occur, possibly due to stress concentration from surface roughening, which is unfavorable. Further, yield strength is 45 kg/mm$^2$ for the upper limit because higher levels in excess of this can result in promotion of wrinkling, and 20 kg/mm$^2$ for the lower limit because lower levels can cause deformation for a container such as depression, etc. easily. Next, reasons for limitations of thickness will be described.

Thicknesses greater than 100 μm could make rigidity of a container increase, and as a result such soft touch-feeling as a plastic container could not be obtained, and also it will make the user refrain from throwing away by crushing with the hand after use. These characteristics required for a foil container are not expected. Thus, the upper limit of thickness is 100 μm, while thickness less than 50 μm steel foil is economically difficult to be manufactured, and so the lower limit is selected by the inventors as 50 μm.

A preferred embodiment will be described as follows.

Some steel types which have such chemical compositions as given in Table 1 were melted in a converter and followed by continuous casting into a slab. The slab was hot rolled to 2.0 mm in thickness in accordance with a usual stripping procedure, and, after hot rolling, A, C and D were coiled at 560° C. and B was coiled at 640° C., into a hot rolled strip. These strips were then manufactured into steel foils to have ultimate thickness 60 μm and 75 μm in accordance with such manufacturing conditions as given in Table 2. The primary cold rolling rate in the table represents a rolling rate at cold rolling performed subsequent to picking of a hot rolled strip, and the primary annealing represents annealing after the primary cold rolling. Thereafter, secondary cold rolling, secondary annealing and third cold rolling come in turn, when crystal grain size measurements were taken in accordance with JIS G 0552. While, ratios of P(222)/P(200) were calculated from peak values for (222) crystal plane and peak values for (200) crystal plane as measured by X-ray diffraction method. For these measurements, an X-ray having Cu as a target was used. To evaluate wrinkling and drawability, an electrolytic chrome chromate treatment (metal Cr; 95 mg/m$^2$ and oxide Cr; 10 mg/m$^2$) was done on steel foils with 60 μm and 75 μm thicknesses manufactured as given in Table 2, and thereafter a polypropylene film as coated in 40 μm on both sides of each foil. Next, the foil was subjected to palm oil lubrication and then drawn into formation of a cylinder and evaluated. To evaluate wrinkling property, rating was done based on a gap between crest and root of a wrinkle; a gap smaller than 15 μm is marked, a gap from 15 to 25 μm is marked and gap over 25 μm is marked Δ. To evaluate drawability, the limiting drawing ratio greater than 2.15 is marked, the same ratio from 1.95 to 2.15 is marked and the same ratio smaller than 1.95 is marked Δ.

The above mentioned embodiment of the present invention has been described with electrolytic chrome chromate treatment as surface treatment, but other treatments such as tinning, phosphating etc. can also be applied as appropriate.

TABLE 1

| Type of Steel | C (wt %) | Mn (wt %) | Al (wt %) |
|---|---|---|---|
| A | 0.021 | 0.20 | 0.058 |
| B | 0.027 | 0.24 | 0.060 |
| C | 0.043 | 0.37 | 0.053 |
| D | 0.073 | 0.55 | 0.062 |

TABLE 2

| Steel Type Symbol | Manufacturing Conditions: Primary roll. rate (%) | Primary anneal. | Second roll. rate (%) | Second anneal. | Third roll. rate (%) | Thick. (μm) | Grain Size | p(222) p(200) | Yield Strength (kg/mm$^2$) | Eval. of Wrinkle | Eval. of Drawability | Class |
|---|---|---|---|---|---|---|---|---|---|---|---|---|
| A | 87 | BAF | 71 | BAF | 15 | 75 | 9 | 1.6 | 24.5 | | | Invention |
| | 87 | BAF | 66 | BAF | 15 | 75 | 8.5 | 1.4 | 42.0 | | | Invention |
| | 87 | BAF | 73 | BAF | 15 | 60 | 9 | 1.4 | 42.5 | | | Invention |
| | 87 | BAF | 68 | CAL | 10 | 75 | 11 | 0.5 | 41.5 | Δ | Δ | Reference |
| | 85 | BAF | 71 | BAF | 15 | 75 | 9 | 1.2 | 43.5 | | | Invention |
| | 85 | BAF | 76 | BAF | 15 | 60 | 9 | 1.2 | 43.5 | | | Invention |
| | 82.5 | BAF | 71 | BAF | 25 | 75 | 9 | 0.7 | 51.0 | Δ | | Reference |
| | 90 | BAF | 56 | BAF | 15 | 75 | 7.0 | 1.2 | 37.5 | | Δ | Reference |
| | 90 | CAL | 56 | BAF | 15 | 75 | 7.0 | 0.9 | 38.5 | | Δ | Reference |
| | 95.5 | BAF | 15 | — | — | 75 | 7.5 | 0.4 | 38.5 | | Δ | Reference |
| B | 87 | BAF | 71 | BAF | 15 | 75 | 9.5 | 1.2 | 25.0 | | | Invention |
| | 87 | BAF | 66 | BAF | 15 | 75 | 8.5 | 1.0 | 43.0 | | | Invention |
| | 87 | BAF | 73 | BAF | 15 | 60 | 9.5 | 1.0 | 43.3 | | | Invention |
| | 85 | BAF | 71 | BAF | 15 | 75 | 9.5 | 0.9 | 43.3 | | | Invention |
| | 95.5 | BAF | 15 | — | — | 75 | 9.5 | 0.2 | 43.5 | Δ | Δ | Reference |
| C | 87 | BAF | 71 | BAF | 15 | 75 | 9.5 | 0.9 | 26.5 | | | Invention |
| | 87 | BAF | 66 | BAF | 15 | 75 | 9 | 0.8 | 43.0 | | | Invention |
| | 90 | BAF | 56 | BAF | 15 | 75 | 7.0 | 0.8 | 40.5 | | Δ | Reference |
| D | 87 | BAF | 71 | BAF | 15 | 75 | 10.5 | 0.55 | 27.5 | Δ | Δ | Reference |

TABLE 2-continued

| Steel Type Symbol | Manufacturing Conditions: Primary roll. rate (%) | Primary anneal. | Second roll. rate (%) | Second anneal. | Third roll. rate (%) | Thick. (μm) | Grain Size | p(222) p(200) | Yield Strength (kg/mm²) | Eval. of Wrinkle | Eval. of Draw-ability | Class |
|---|---|---|---|---|---|---|---|---|---|---|---|---|
| | 87 | BAF | 66 | BAF | 15 | 75 | 10 | 0.5 | 43.0 | Δ | Δ | Reference |

BAF: Batch annealing CAL: Continuous annealing

As apparent from the embodiment, a steel foil according to the present invention, wherein composition of steel, crystal grain size, texture and yield strength are selected to be an optimum condition, is less in occurrence of wrinkles and has higher drawability and is superior for a container to be drawn with organic film coat.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A steel foil for drawing a container with an organic film coat which is superior in drawability comprising:

above 0.01% carbon and 0.06% and under carbon, 0.1 to 0.5% manganese, 0.01 to 0.10% aluminum and the balance of iron and inevitable impurities, and the foil having a crystal grain size which is 7.5 to 10 in grain size number (JIS G 0552) and the foil having a ratio of peak values of P(222) to P(200) in intensity of X-ray diffraction in a plane parallel to a sheet surface, i.e. a P(222)/P(200) ratio, which is larger than 0.6 and which has a yield strength of 20 to 45 kg/mm² and a thickness of 50 to 100 μm.

* * * * *

UNITED STATES PATENT AND TRADEMARK OFFICE

CERTIFICATE OF CORRECTION

PATENT NO. : 4,956,242

DATED : September 11, 1990

INVENTOR(S) : Keiichi Shimizu, et al.

It is certified that error appears in the above-identified patent and that said Letters Patent is hereby corrected as shown below:

Column 4, line 27 for "15 μm is marked" read -- 15 μm is marked ◎ --.

Column 4, line 27 for "25 μm is marked" read -- 25 μm is marked ○ --.

Column 4, line 29 for "is marked" read -- is marked ◎ --.

Column 4, line 30 for "is marked" read -- is marked ○ --.

Column 4, Table 2:

In the "Eval. of Wrinkle" column:

the blank box next to "24.5" in the "Yield Strength" column should read -- ◎ --.

the blank box next to "42.0" in the "Yield Strength" column should read -- ◎ --.

the blank box next to "42.5" in the "Yield Strength" column should read -- ◎ --.

the blank box next to "43.5" (both occurrences) in the "Yield Strength" column should read -- ◎ --.

UNITED STATES PATENT AND TRADEMARK OFFICE

CERTIFICATE OF CORRECTION

PATENT NO. : 4,956,242

DATED : September 11, 1990

INVENTOR(S) : Keiichi Shimizu, et al.

It is certified that error appears in the above-identified patent and that said Letters Patent is hereby corrected as shown below:

the blank box next to "37.5" in the "Yield Strength" column should read -- ⊙ --.

the blank box next to "38.5" (both occurrences) in the "Yield Strength" column should read -- ⊙ --.

the blank box next to "25.0" in the "Yield Strength" column should read -- ⊙ --.

the blank box next to "43.0" (first occurrence) in the "Yield Strength" column should read -- ⊙ --.

the blank box next to "43.3" (first occurrence) in the "Yield Strength" column should read -- ⊙ --.

the blank box next to "43.3" (second occurrence) in the "Yield Strength" column should read -- ○ --.

the blank box next to "26.5" in the "Yield Strength" column should read -- ○ --.

the blank box next to "43.0" (second occurrence) in the "Yield Strength" column should read -- ○ --.

the blank box next to "40.5" in the "Yield Strength" column should read -- ○ --.

UNITED STATES PATENT AND TRADEMARK OFFICE

CERTIFICATE OF CORRECTION

PATENT NO. : 4,956,242

DATED : September 11, 1990

INVENTOR(S) : Keiichi Shimizu, et al.

It is certified that error appears in the above-identified patent and that said Letters Patent is hereby corrected as shown below:

In the "Eval. of Drawability" column:

the blank box next to "24.5" in the "Yield Strength" column should read -- ◎ --.

the blank box next to "42.0" in the "Yield Strength" column should read -- ◎ --.

the blank box next to "42.5" in the "Yield Strength" column should read -- ◎ --.

the blank box next to "43.5" (both occurrences) in the "Yield Strength" column should read -- ◎ --.

the blank box next to "51.0" in the "Yield Strength" column should read -- ○ --.

the blank box next to "25.0" in the "Yield Strength" column should read -- ⊙ --.

the blank box next to "43.0" (first occurrence) in the "Yield Strength" column should read -- ⊙ --.

the blank box next to "43.3" (first occurrence) in the "Yield Strength" column should read -- ⊙ --.

UNITED STATES PATENT AND TRADEMARK OFFICE

CERTIFICATE OF CORRECTION

PATENT NO. : 4,956,242

DATED : September 11, 1990

INVENTOR(S) : Keiichi Shimizu, et al.

It is certified that error appears in the above-identified patent and that said Letters Patent is hereby corrected as shown below:

the blank box next to "43.3" (second occurrence) in the "Yield Strength" column should read -- ◯ --.

the blank box next to "26.5" in the "Yield Strength" column should read -- ◯ --.

the blank box next to "43.0" (second occurrence) in the "Yield Strength" column should read -- ◯ --.

Signed and Sealed this

Twenty-first Day of July, 1992

*Attest:*

DOUGLAS B. COMER

*Attesting Officer*

*Acting Commissioner of Patents and Trademarks*